US009379457B2

(12) United States Patent
Shiue

(10) Patent No.: US 9,379,457 B2
(45) **Date of Patent: *Jun. 28, 2016**

(54) RADOME FOR FEED HORN AND ASSEMBLY OF FEED HORN AND RADOME

(71) Applicant: PRIME ELECTRONICS AND SATELLITICS INCORPORATION, Chung-Li, Taoyuan County (TW)

(72) Inventor: Li-Chun Shiue, Chung-Li (TW)

(73) Assignee: PRIME ELECTRONICS AND SATELLITICS INCORPORATION, Chung-Li, Taoyuan County (TW)

( * ) Notice: Subject to any disclaimer, the term of this patent is extended or adjusted under 35 U.S.C. 154(b) by 224 days.

This patent is subject to a terminal disclaimer.

(21) Appl. No.: 14/244,280

(22) Filed: Apr. 3, 2014

(65) Prior Publication Data

US 2014/0375517 A1 Dec. 25, 2014

(30) Foreign Application Priority Data

Apr. 3, 2013 (TW) ..... 102206206 U
Apr. 3, 2013 (TW) ..... 102206209 U

(51) Int. Cl.
*H01Q 1/42* (2006.01)
*H01Q 25/04* (2006.01)
*H01Q 13/02* (2006.01)

(52) U.S. Cl.
CPC ..... *H01Q 25/04* (2013.01); *H01Q 1/42* (2013.01); *H01Q 13/0225* (2013.01)

(58) Field of Classification Search
CPC ..... H01Q 25/04; H01Q 13/0225
USPC ..... 343/776, 784, 872
See application file for complete search history.

(56) References Cited

U.S. PATENT DOCUMENTS

| | | | | |
|---|---|---|---|---|
| 3,413,642 | A | 11/1968 | Cook | |
| 3,754,273 | A | 8/1973 | Takeichi et al. | |
| 2005/0259026 | A1* | 11/2005 | Cook | H01Q 13/0225 343/779 |
| 2009/0021442 | A1* | 1/2009 | Syed | H01Q 1/24 343/781 CA |
| 2014/0292605 | A1* | 10/2014 | Roberts | H01Q 13/20 343/781 CA |

FOREIGN PATENT DOCUMENTS

| | | |
|---|---|---|
| TW | I223467 B | 11/2004 |
| TW | I223469 B | 11/2004 |

* cited by examiner

*Primary Examiner* — Hoanganh Le
(74) *Attorney, Agent, or Firm* — Muncy, Geissler, Olds & Lowe, P.C.

(57) ABSTRACT

A radome for a feed horn includes a cover and at least a protrusion having an elliptic protruding portion shaped as a part of a hollow ellipsoid and provided with a convex surface and a concave surface opposite to the convex surface. The radome is defined with a plurality of first and second cross-sections. Curves of the convex and the concave surfaces in the first cross-sections are different from those in the second cross-sections. The convex and concave surfaces are substantially perpendicular to an advancing direction of a co-polarization wave and unperpendicular to an advancing direction of a cross polarization wave. As a result, the radome can be so thick as to be easily manufactured and not easily damaged and enhance the performance of the feed horn covered by the radome in sending and receiving signals.

20 Claims, 15 Drawing Sheets

RADOME FOR FEED HORN AND ASSEMBLY OF FEED HORN AND RADOME

CROSS-REFERENCE TO RELATED APPLICATIONS

This application claims priorities from Taiwan Patent Application Nos. 102206206 and 102206209 both filed on Apr. 3, 2013, the entire contents of which are incorporated herein by reference.

BACKGROUND OF THE INVENTION

1. Field of the Invention

The present invention relates generally to feed horns and more particularly, to a radome for a feed horn and an assembly of a feed horn and a radome.

2. Description of the Related Art

A feed horn is a component of a signal transmission device, such as a satellite television antenna, for receiving signals of one or a plurality of frequency bands and feeding the signals to a signal processor and then to a client device. Alternatively, the feed horn can be used reversely to send out processed signals of one or a plurality of frequency bands.

In some cases, such as Taiwan Patent No. I223467, an opening of the feed horn is covered by a radome. In general, the radome for the feed horn has only functions of water resistance and blocking out foreign objects, and may have a disadvantage of deteriorating the performance of the feed horn in receiving and sending signals. A radome for a high-grade feed horn has a specific design that a surface of the radome is perpendicular to advancing directions of electric waves passing through the feed horn. However, the aforesaid specific design of the radome can improve the performance of the feed horn in receiving and sending signals slightly. To minimize the interference from the radome in electric-waves transmission of the feed horn, the conventional radome for the feed horn is designed to be very thin in its thickness; therefore the conventional radome is difficult in manufacturing and liable to be damaged.

In some cases, such as U.S. Pat. No. 3,413,642 and No. 3,754,273, the feed horn is provided with a plurality of circular side-lobe-reducing corrugations protruding or concaved from an inner surface of the feed horn to reduce edge diffraction occurring at the peripheral of the opening of the feed horn and lowering the isolation of cross polarization waves and co-polarization waves. However, the side-lobe-reducing corrugations are made integrally at the inner surface of the feed horn, resulting in difficulties in manufacturing.

Alternatively, the feed horn might be provided with a plurality of side-lobe-reducing corrugations extending from an outer surface of the feed horn and surrounding the opening of the feed horn in a concentric circle manner. For example, Taiwan Patent No. I223469 disclosed a feed horn having two side-lobe-reducing corrugations surrounding an opening of the feed horn. This kind of side-lobe-reducing corrugations located at the outer surface is more easily made than the aforesaid side-lobe-reducing corrugations located at the inner surface; however, the feed horn with such design may have a big size, resulting in inconvenience in application. Besides, this kind of feed horn usually has at least two side-lobe-reducing corrugations for good performance in reducing side lobes; the more side-lobe-reducing corrugations the feed horn has, the larger the feed horn is. In particular, for the feed horn having a plurality of channels for receiving signals of a plurality of frequency bands, each of the channels should be provided with at least two side-lobe-reducing corrugations surrounding an opening thereof so that the feed horn is very large in dimension and very inconvenient in application.

SUMMARY OF THE INVENTION

The present invention has been accomplished in view of the above-noted circumstances. It is an objective of the present invention to provide a radome for a feed horn and an assembly of the feed horn and the radome, wherein the radome can be so thick as to be easily manufactured and not easily damaged, enhancing the performance of the feed horn in receiving and sending signals.

To attain the above objective, the present invention provides a radome which is adapted for covering a feed horn and being passed through by a co-polarization wave and a cross polarization wave substantially perpendicular to the co-polarization wave and comprises a cover and at least a protrusion. The cover is provided with a back surface facing an inside of the feed horn and an exposed front surface. The protrusion has an elliptic protruding portion shaped as a part of a hollow ellipsoid and having a convex surface and a concave surface opposite to the convex surface. The radome is defined with a plurality of first cross-sections parallel to a first axis and a second axis substantially perpendicular to the first axis, and a plurality of second cross-sections parallel to the first axis and a third axis substantially perpendicular to the first axis and the second axis. Curves of the convex surface and the concave surface in the first cross-sections are different from curves of the convex surface and the concave surface in the second cross-sections. The convex surface and the concave surface are substantially perpendicular to an advancing direction of the co-polarization wave and unperpendicular to an advancing direction of the cross polarization wave.

To attain the above objective, the present invention provides an assembly of a feed horn and the aforesaid radome covering the feed horn. The feed horn comprises at least a wave guiding unit having a pipe, a wave guiding space in the pipe, and an opening located at an end of the pipe, and defined with a central axis substantially passing through the opening perpendicularly. The concave surface of the elliptic protruding portion of the protrusion of the radome faces the wave guiding space of the feed horn.

As a result, the interference from the radome in the co-polarization wave is minimized by the feature that the concave surface and the convex surface of the elliptic protruding portion of the radome are substantially perpendicular to the advancing direction of the co-polarization wave. At the same time, the interference in the cross polarization wave is increased by the feature that the concave surface and the convex surface of the radome are substantially unperpendicular to the advancing direction of the cross polarization wave. Therefore, even if the radome is configured so thick as to be easily manufactured and not easily damaged, the configuration design of the convex surface and the concave surface will cause high isolation to the co-polarization wave and the cross polarization wave so as to enhance the performance of the feed horn in receiving and sending signals.

It is another objective of the present invention to provide an assembly of a feed horn and a radome, wherein the feed horn has a side-lobe-reducing corrugation and is easily made and small-sized.

To attain the above objective, the wave guiding unit of the feed horn in the aforesaid assembly further has at least a tilted side-lobe-reducing corrugation located at an outside of the pipe and having an inner surface facing the pipe. The inner surface has a first end and a second end and is tilted relative to the central axis from the first end to the second end. The first end is farther from the opening of the pipe and more close to the central axis than the second end.

As a result, the feed horn is relatively easier to be made because the tilted side-lobe-reducing corrugation is located at the outside, instead of the inside, of the pipe. Besides, the inner surface of the tilted side-lobe-reducing corrugation is tilted to face the opening of the pipe and therefore able to reflect parts of electric waves passing through the opening to the outside of the opening at a predetermined distance from the opening. In this way, the electric waves reflected by the inner surface and the cross polarization waves without being reflected will have therebetween a phase difference of about 180 degrees and counteract together for phase offset modulation. Therefore, the side-lobe-reducing corrugation causes good performance in reducing side lobes to the feed horn and is relatively small-sized so that the feed horn is relatively small-sized and easier in manufacturing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
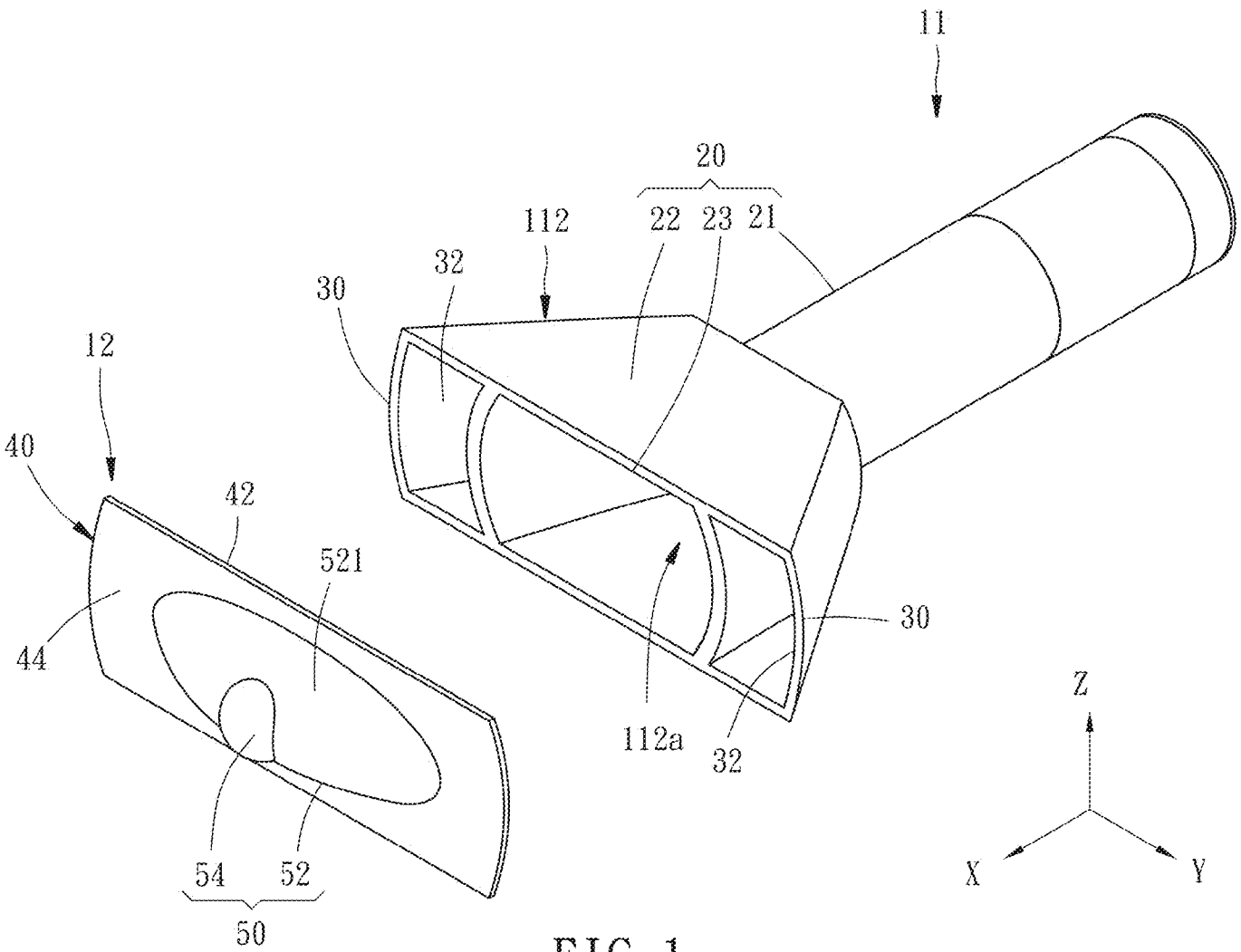
FIG. 1 is an exploded perspective view of a feed horn and a radome according to a first preferred embodiment of the present invention.

First of all, it is to be mentioned that same reference numerals used in the following preferred embodiments and the appendix drawings designate same or similar elements throughout the specification for the purpose of concise illustration of the present invention.

Referring to FIG. 1, an assembly of a feed horn 11 and a radome 12 covering the feed horn 11 is provided according to a first preferred embodiment of the present invention. The radome 12 can be passed through by a co-polarization wave and a cross polarization wave, which are received or sent out by the feed horn 11 and advance spirally and perpendicularly to each other at the same time.

The feed horn 11 comprises a wave guiding unit 112 having a pipe 20 and two tilted side-lobe-reducing corrugations 30. In the present invention, a single wave guiding unit 112 has a wave guiding space 112*a* formed by the pipe 20 and able to be passed through by signals of a specific frequency band. The single wave guiding unit 112 might, but not limited to, further have at least a tilted side-lobe-reducing corrugation 30. In other words, if a feed horn has two wave guiding spaces, the feed horn has two wave guiding units, and so on.

Figure 2:
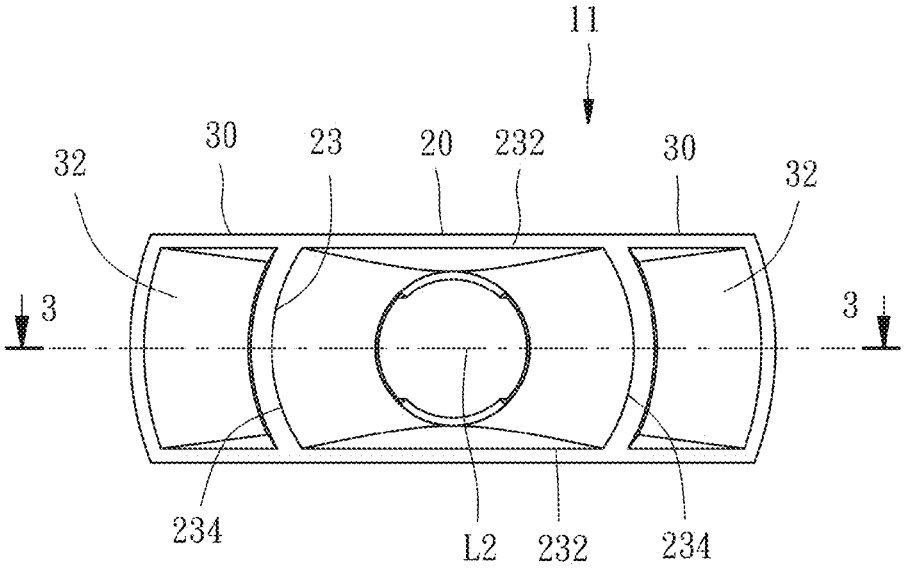
FIG. 2 is a lateral side view of the feed horn according to the first preferred embodiment of the present invention.
Figure 3:
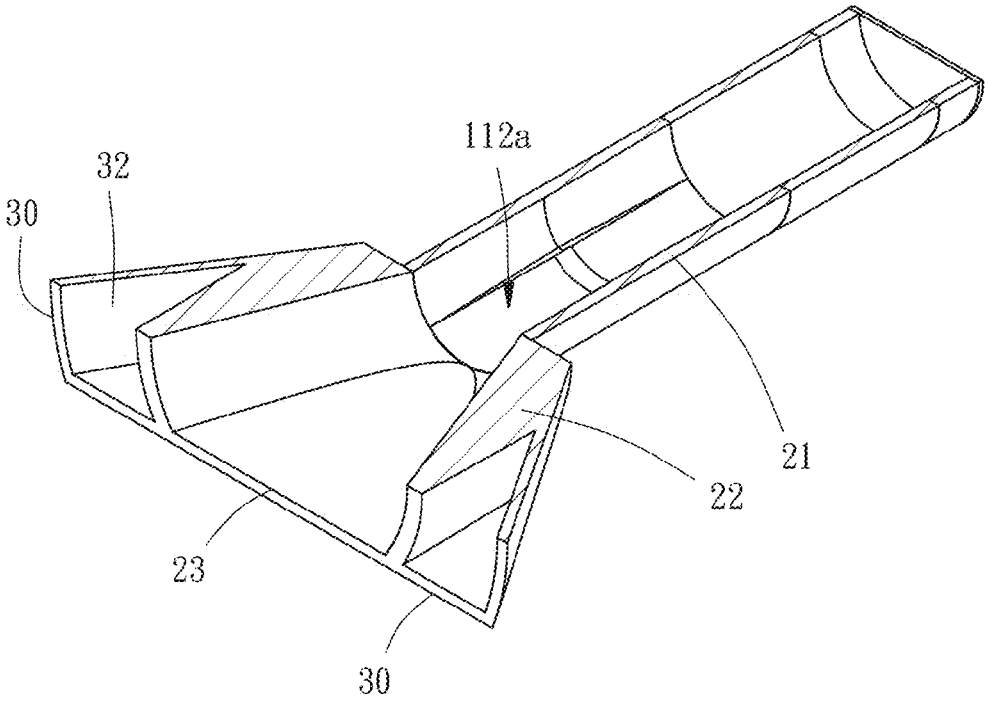
FIG. 3 is a perspective cutaway view taking along the line 3-3 in FIG. 2.
Figure 4:
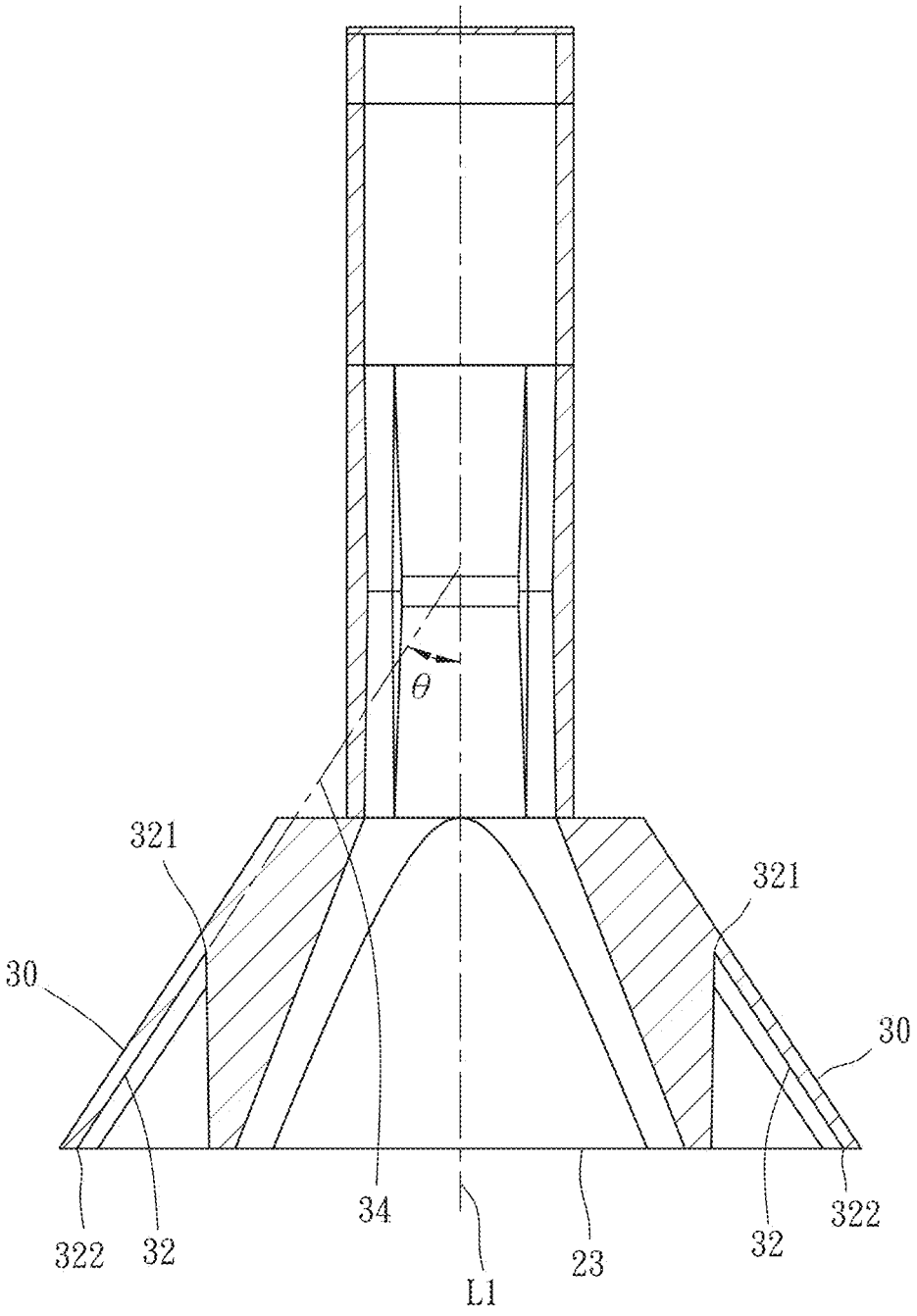
FIG. 4 is a sectional plane view taking along the line 3-3 in FIG. 2.
Figure 5:
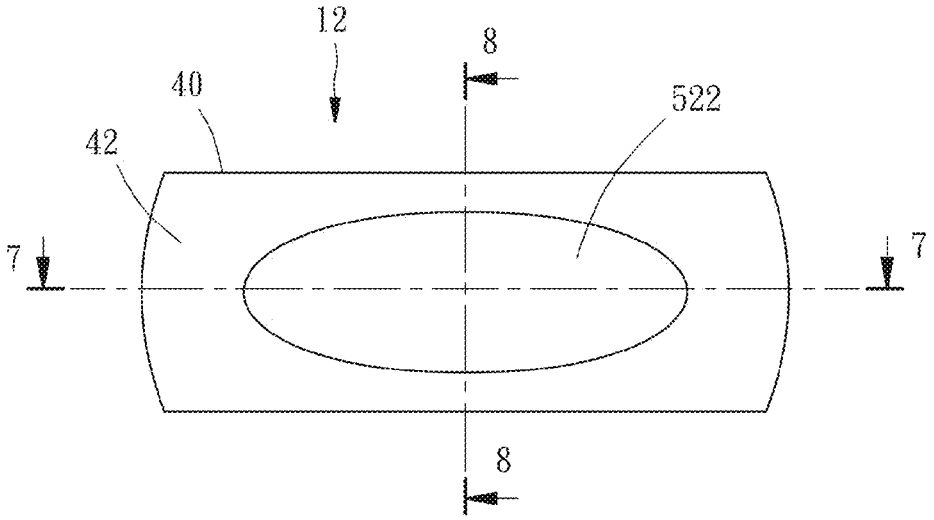
FIG. 5 is a plane view of the back of the radome according to the first preferred embodiment of the present invention.

Referring to FIGS. 2-4, the pipe 20 has a first section 21 having equiradial circular inner contours in sectional views, a second section 22 extending from an end of the first section 21 and gradually increasing in diameter along an axial direction, and an opening 23 located at an end of the second section 22. The pipe 22 is defined with a central axis L1 substantially passing through the opening 23 perpendicularly. The opening 23 is elongated like an oblong and therefore defined with a long axis L2 connecting two most distant points of the opening 23.

The tilted side-lobe-reducing corrugations 30 are integrally connected with the outside of the pipe 20 and located at two ends of the long axis L2, respectively. Each of the tilted side-lobe-reducing corrugations 30 has an inner surface 32 facing the pipe 20 and tilted relative to the central axis L1 from a first end 321 to a second end 322; the first end 321 is farther from the opening 23 of the pipe 20 and more close to the central axis L1 than the second end 322. In this way, an extension plane 34 of the inner surface 32 of each tilted side-lobe-reducing corrugation 30 intersects the central axis L1; an included angle θ between the extension plane 34 and the central axis L1 is optimal to be more than or equal to 30 degrees and less than or equal to 60 degrees.

As a result, the inner surface 32 of each tilted side-lobe-reducing corrugation 30 is tilted to face the opening 23 of the pipe 20 and therefore able to reflect parts of electric waves passing through the opening 23 to the outside of the opening 23 at a predetermined distance from the opening 23. In this way, the cross polarization waves reflected by the inner surfaces 32 and the cross polarization waves without being reflected will have therebetween a phase difference of about 180 degrees and counteract together for phase offset modulation. Therefore, although there is only a side-lobe-reducing corrugation 30 located by each of two sides of the opening 23, the feed horn 11 still has good performance in reducing side lobes. In other words, the side-lobe-reducing corrugations 30 of the feed horn 11, which are smaller than the side-lobe-reducing corrugations of conventional feed horns, have not only the same function of reducing edge diffraction with the conventional side-lobe-reducing corrugations but also a further function of increasing the isolation of the co-polarization waves and the cross polarization waves by the feature that the tilted inner surface can reflect the electric waves to perform phase offset modulation of the cross polarization waves.

Referring to FIG. 1 and FIGS. 5-8, the radome 12 comprises a flat cover 40 and a protrusion 50 integrally connected with the cover 40 at the center of the cover 40.

The cover 40 is adapted to be fixed to the feed horn 11. In this embodiment, the cover 40 and the protrusion 50 are both located out of the wave guiding space 112*a*; however, the cover 40 can be configured to be bent and extend into the wave guiding space 112*a* so that the protrusion 50 is located in the wave guiding space 112*a*. The cover 40 is provided with a back surface 42 facing an inside of the feed horn 11 and a front surface 44 exposed outside.

The protrusion 50 has an elliptic protruding portion 52 shaped as a part of a hollow ellipsoid and a spherical protruding portion 54 shaped as a part of a spheroid. The elliptic protruding portion 52 has a convex surface 521 curved outward from the front surface 44 of the cover 40 and a concave surface 522 curved inward from the back surface 42 of the cover 40. The concave surface 522 is a smoothly curved surface facing the wave guiding space 112*a* of the feed horn 11. The spherical protruding portion 54 is protruded from the center of the convex surface 521 of the elliptic protruding portion 52.

Figure 7:
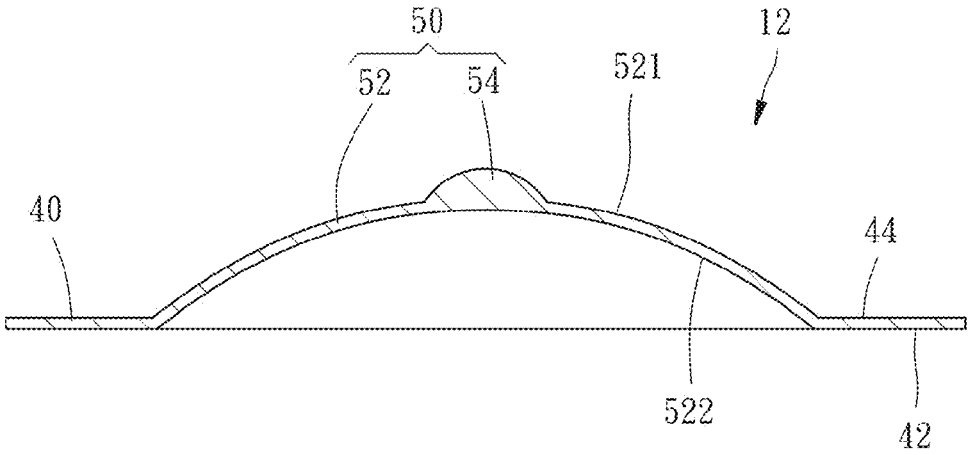
FIG. 7 is a sectional view taking along the line 7-7 in FIG. 5.
Figure 8:
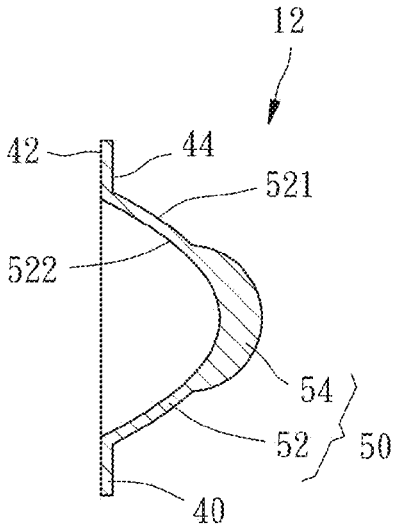
FIG. 8 is a sectional view taking along the line 8-8 in FIG. 5.
Figure 9:
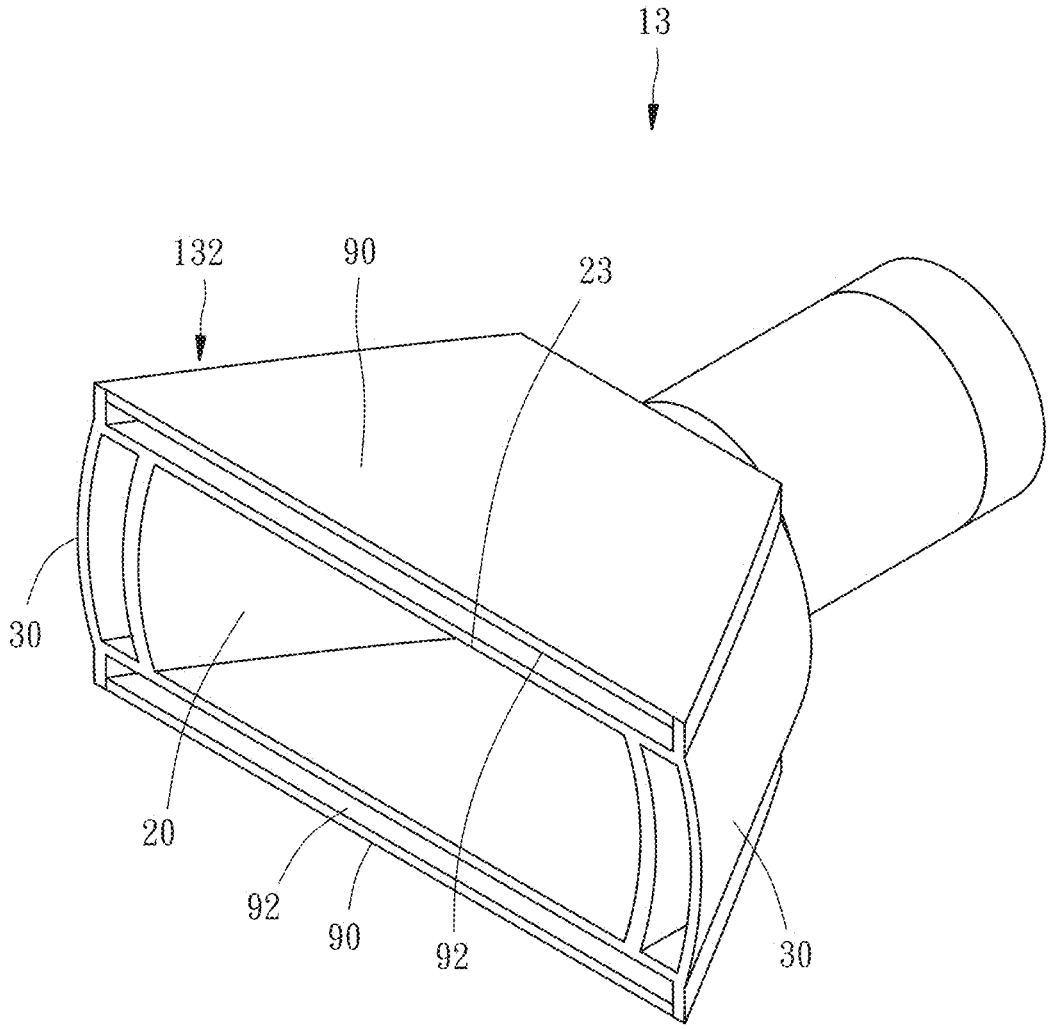
FIG. 9 is a perspective view of a feed horn according to a second preferred embodiment of the present invention.
Figure 10:
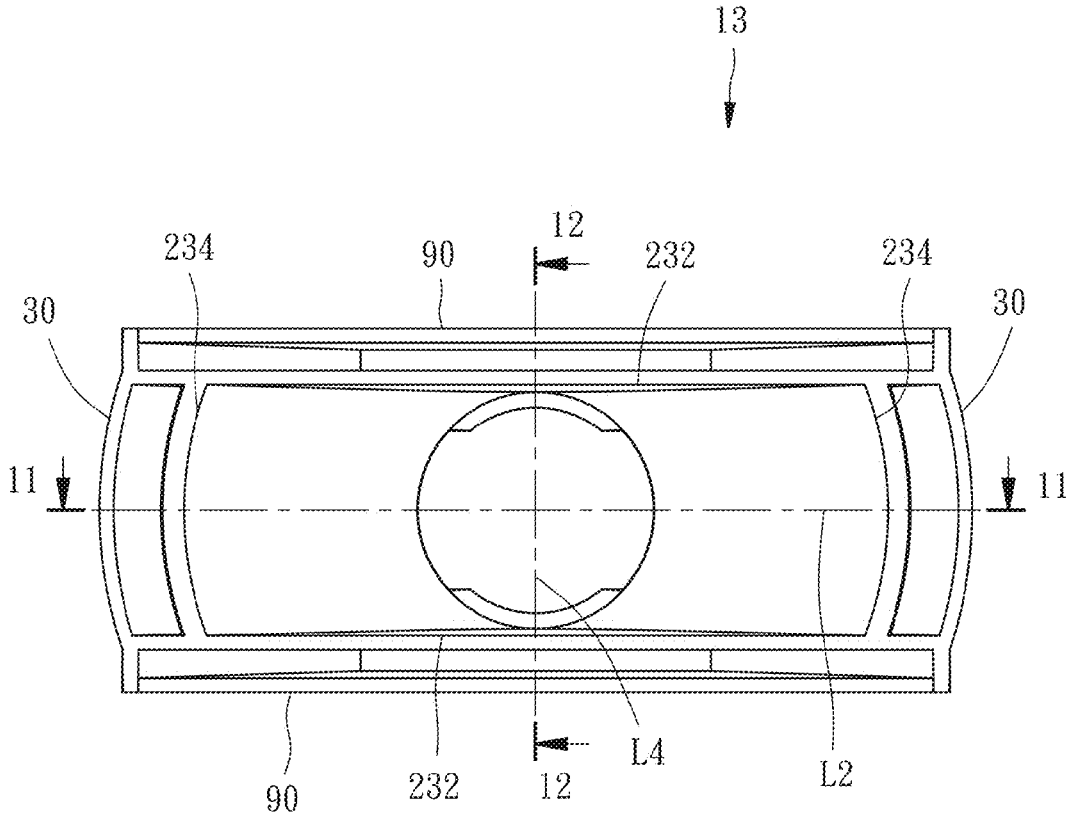
FIG. 10 is a lateral side view of the feed horn according to the second preferred embodiment of the present invention.
Figure 11:
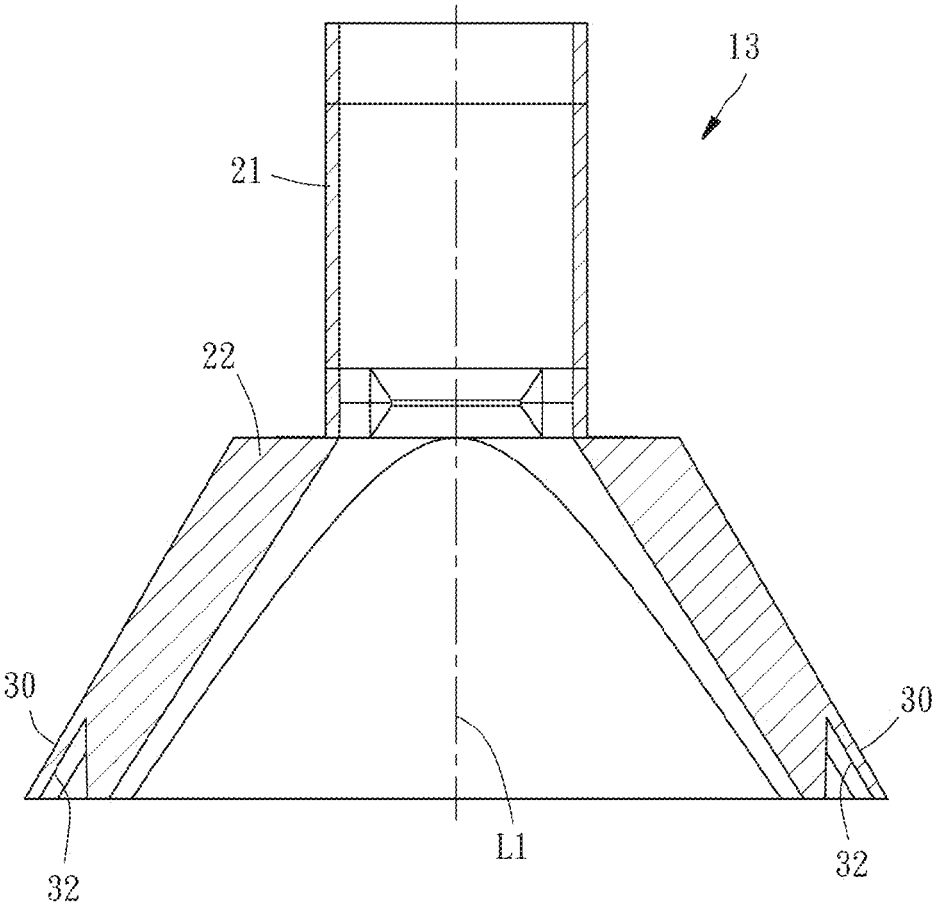
FIG. 11 is a sectional view taking along the line 11-11 in FIG. 10.
Figure 12:
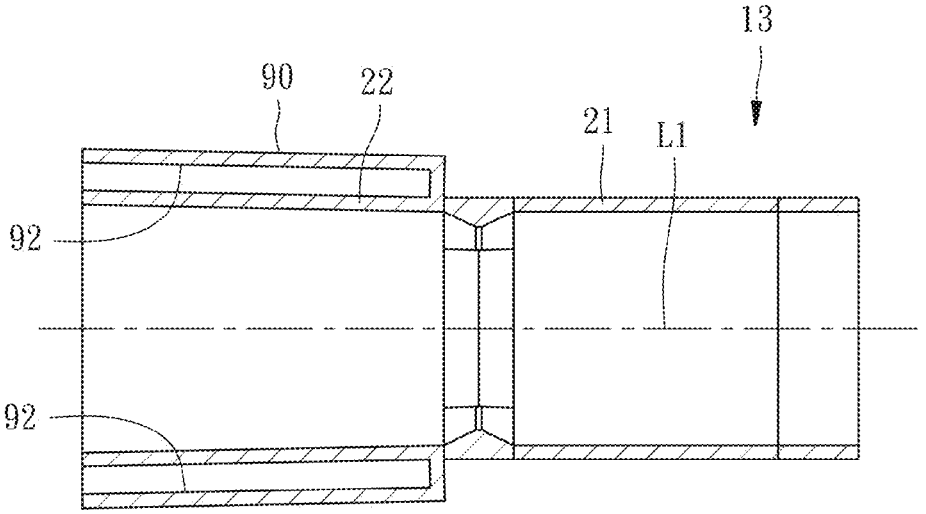
FIG. 12 is a sectional view taking along the line 12-12 in FIG. 10.
Figure 13:
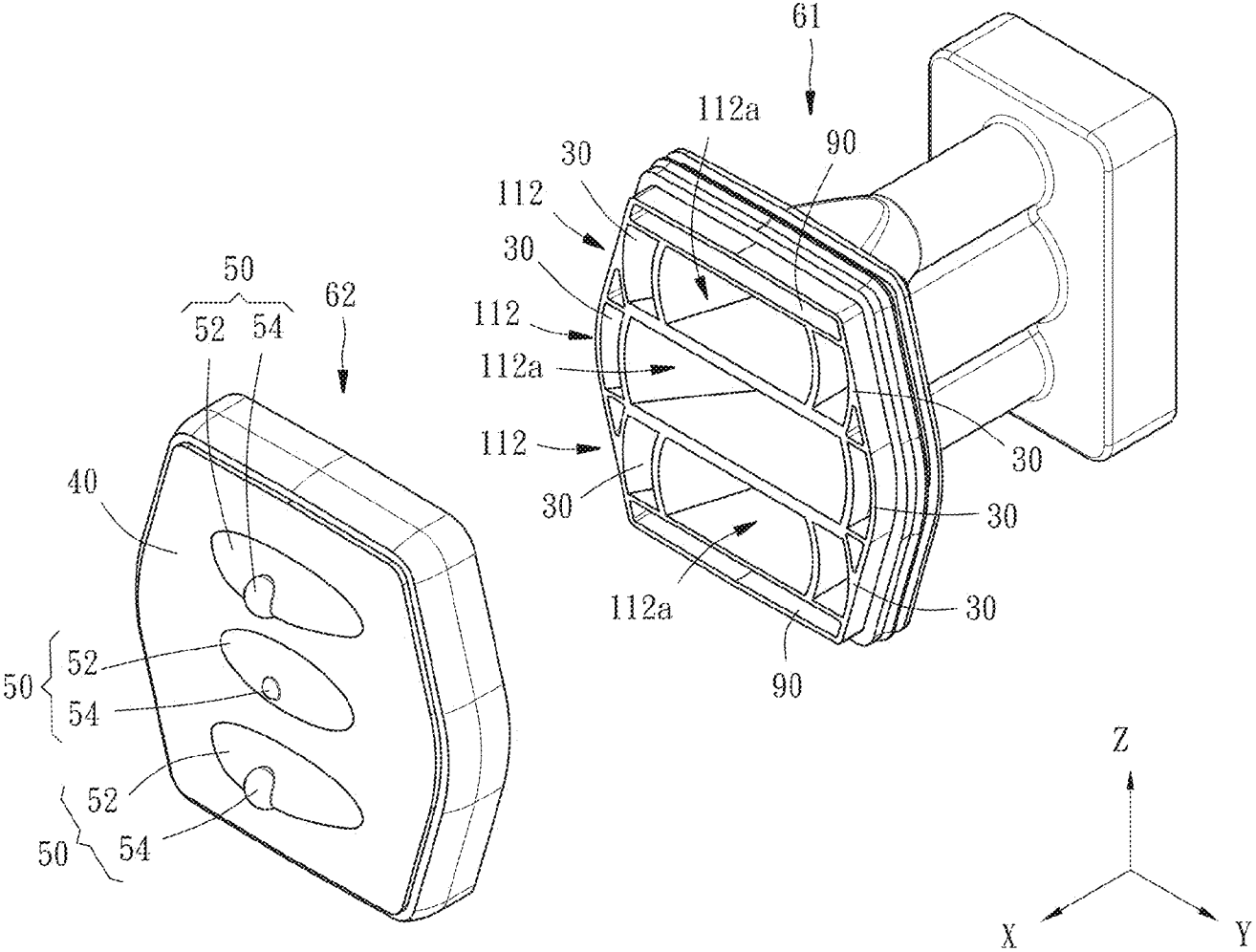
FIG. 13 is an exploded perspective view of a feed horn and a radome according to a third preferred embodiment of the present invention.
Figure 14:
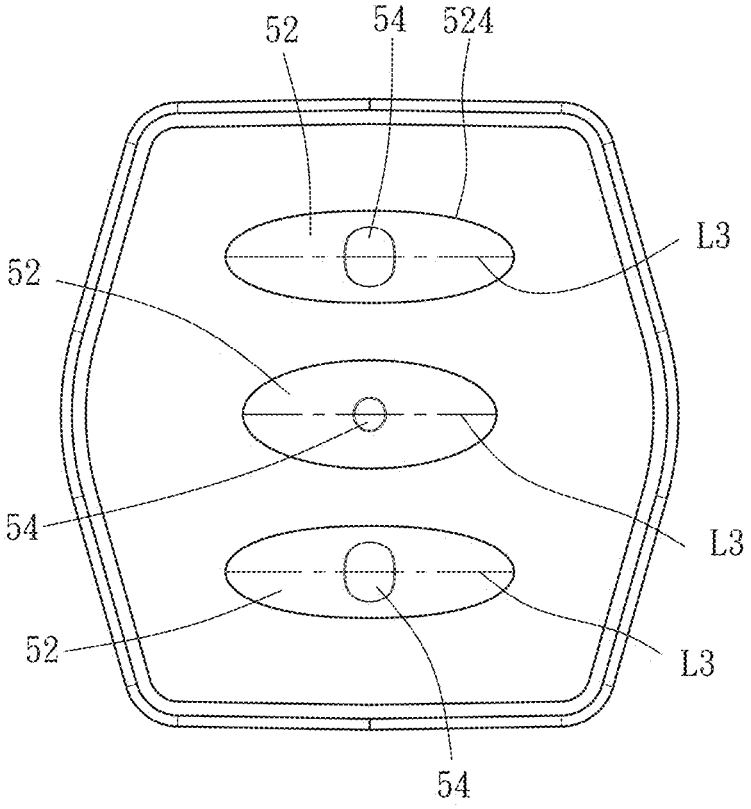
FIG. 14 is a plane view of the front of the radome according to the third preferred embodiment of the present invention.
Figure 15:
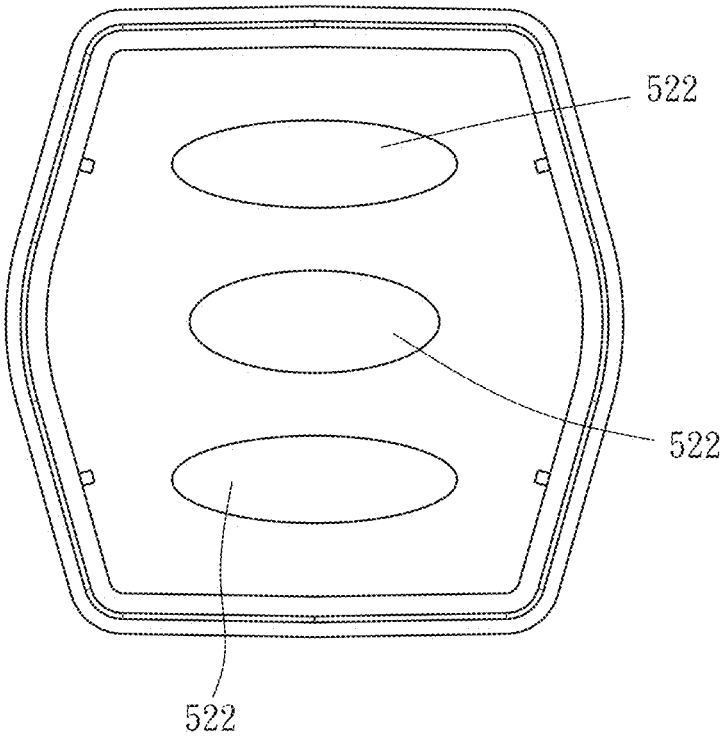
FIG. 15 is a plane view of the back of the radome according to the third preferred embodiment of the present invention.
Figure 16:
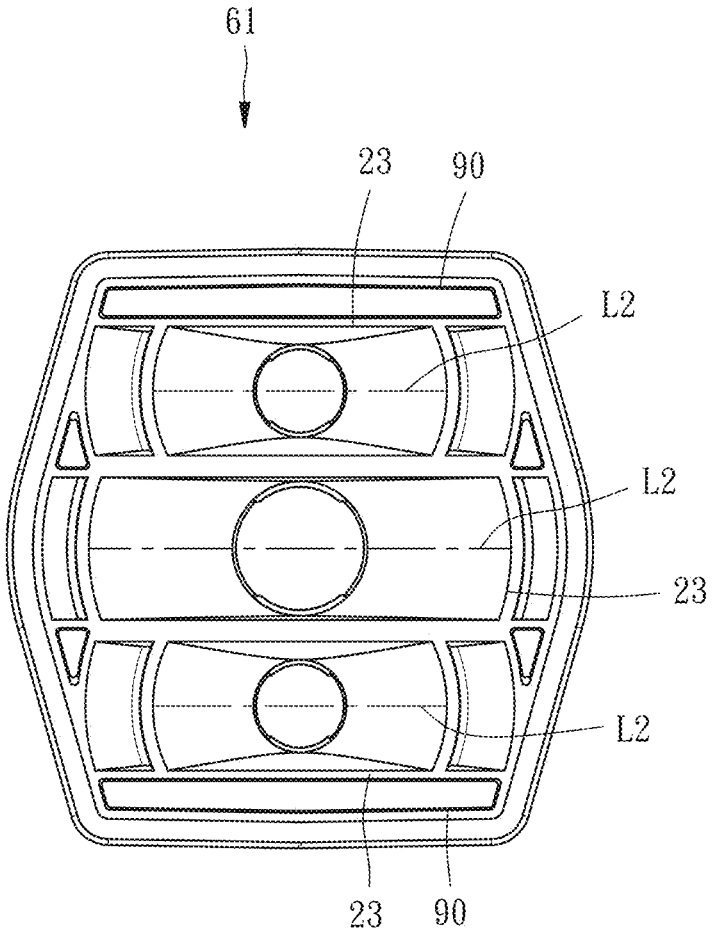
FIG. 16 is a lateral side view of the feed horn according to the third preferred embodiment of the present invention.

The radome 12 is defined with a plurality of first cross-sections parallel to a first axis (X-axis) and a second axis (Y-axis), such as the cross-section shown in FIG. 7, and a plurality of second cross-sections parallel to the first axis (X-axis) and a third axis (Z-axis), such as the cross-section shown in FIG. 8. The second axis (Y-axis) is substantially perpendicular to the first axis (X-axis), and the third axis (Z-axis) is substantially perpendicular to the first axis (X-axis) and the second axis (Y-axis). As shown in FIG. 7, each curve of the convex surface 521 and the concave surface 522 of the elliptic protruding portion 52 of the protrusion 50 in each of the first cross-sections is a circular arc with a consistent radius of curvature. As shown in FIG. 8, each curve of the convex surface 521 and the concave surface 522 in each of the second cross-sections has a center, two ends and an inconsistent radius of curvature increasing from the center to the ends.

Figure 6:
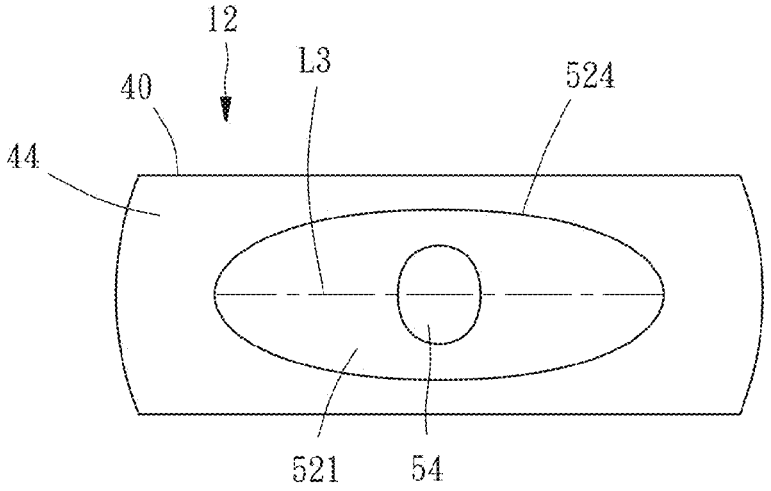
FIG. 6 is a plane view of the front of the radome according to the first preferred embodiment of the present invention.

As shown in FIG. 6, the elliptic protruding portion 52 of the radome 12 has an outer contour 524 which is elongated and therefore defined with a long axis L3 connecting two most distant points of the outer contour 524. The outer contour 524 is elliptic in this embodiment, but not limited to be elliptic. The long axis L3 is parallel to the second axis (Y-axis) and the long axis L2 of the opening 23 of the feed horn 11.

Because of the specific design of the elliptic protruding portion 52 of the radome 12, the convex surface 521 and the concave surface 522 are substantially perpendicular to the advancing direction of the co-polarization wave so that the interference from the radome 12 in the co-polarization wave is minimized. At the same time, the convex surface 521 and the concave surface 522 are substantially unperpendicular to the advancing direction of the cross polarization wave so that the interference in the cross polarization wave is raised. As a result, even if the radome 12 is configured so thick as to be easily manufactured and not easily damaged, the configuration design of the convex surface 521 and the concave surface 522 will cause high isolation to the co-polarization wave and the cross polarization wave so as to enhance the performance of the feed horn in receiving and sending signals.

Besides, the spherical protruding portion 54 of the radome 12 can also increase the isolation of the co-polarization wave and the cross polarization wave and has the same function of focusing with a convex lens so as to increase the directivity of the electric waves passing through the radome 12. However, the radome 12 can be provided with no such spherical protruding portion 54.

It will be appreciated that the elongated outer contour 524 of the elliptic protruding portion 52 of the radome 12 is configured corresponding to the opening 23 of the feed horn 11 so that most of the electric waves passing through the opening 23 will be affected by the elliptic protruding portion 52 and therefore increased in the isolation of the co-polarization wave and the cross polarization wave. However, the shapes of the elliptic protruding portion 52 and the opening 23 of the feed horn 11 are not limited to the shapes in this embodiment and not limited to be elongated.

Referring to FIGS. 9-12, a feed horn 13 according to a second preferred embodiment of the present invention comprises a wave guiding unit 132 having not only a pipe 20 and two tilted side-lobe-reducing corrugations 30 similar to that mentioned in the aforesaid first preferred embodiment but also two parallel side-lobe-reducing corrugations 90 located at the outside of the pipe 20.

The opening 23 of the pipe 20 is defined with a short axis L4 perpendicular to the long axis L2. The parallel side-lobe-reducing corrugations 90 are located at two ends of the short axis L4, respectively. Each of the parallel side-lobe-reducing corrugations 90 has an inner surface 92 facing the pipe 20 and substantially parallel to the central axis L1. Because of the parallel side-lobe-reducing corrugations 90, the feed horn 13 has better performance in reducing side lobes than the aforesaid feed horn 11.

In the aforesaid embodiments, the opening 23 of the pipe 20 has two straight long sides 232 and two arc short sides 234. In the first preferred embodiment, the tilted side-lobe-reducing corrugations 30 are located by the short sides 234, respectively. In the second preferred embodiment, the tilted side-lobe-reducing corrugations 30 are located by the short sides 234 respectively, and the parallel side-lobe-reducing corrugations 90 are located by the long sides 232, respectively. In the present invention, the shape of the opening 23 of the feed horn is not limited to the shape mentioned in the aforesaid embodiments and not limited to be elongated. However, for the design with the elongated opening 23, such as elliptic opening, it is optimal that the tilted side-lobe-reducing corrugations 30 are located at two ends of the long axis L2 respectively and the parallel side-lobe-reducing corrugations 90 are located at two ends of the short axis L4, respectively.

According to the above contents, the major characteristic of the feed horn of the present invention is the tilted side-lobe-reducing corrugation 30 having the inner surface 32 tilted relative to the central axis L1, which can enhance the performance of the feed horn in reducing side lobes. Therefore, the amount and the position of the tilted side-lobe-reducing corrugation 30 are not limited. For example, a single wave guiding unit may have only a tilted side-lobe-reducing corrugation, and the pipe is surrounded by the tilted side-lobe-reducing corrugation and the tilted inner surface thereof.

In the present invention, the feed horn may comprise a plurality of wave guiding units; in this event, the radome may comprise a plurality of protrusions. For example, an assembly of a feed horn 61 and a radome 62 according to a third preferred embodiment is shown in FIGS. 13-16, wherein the feed horn 61 comprises three wave guiding units 112 as described before and the radome 62 comprises a cover 40 as described before and three protrusions 50 integrally connected with the cover 40.

The openings 23 of the wave guiding units 112 of the feed horn 61 are elongated and the long axes L2 thereof are substantially parallel to each other. The wave guiding units 112 are aligned along a direction substantially perpendicular to the long axes L2. Each of the wave guiding units 112 has two tilted side-lobe-reducing corrugations 30 located at two ends of the long axis L2, respectively. Two of the wave guiding units 112 each further have a parallel side-lobe-reducing corrugation 90. As a result, the feed horn 61 has a function of receiving or sending out signals of three specific frequency bands and advantages of small size and being manufactured easily. Besides, the feed horn 61 has relatively better performance in reducing the edge diffraction which occurs at the peripheral of the openings 23 and deteriorates the isolation of the cross polarization wave and the co-polarization wave.

The concave surfaces 522 of the elliptic protruding portions 52 of the protrusions 50 face the wave guiding spaces 112*a* of the wave guiding units 112, respectively. The long axes L3 of the outer contours 524 of the elliptic protruding portions 52 and the long axes L2 of the openings 23 of the wave guiding units 112 are substantially parallel to the second axis (Y-axis). The protrusions 50 are aligned substantially along the third axis (Z-axis). As a result, the protrusions 50 can affect the electric waves passing through the wave guiding spaces 112*a* respectively and increase the isolation and the directivity of the electric waves.

Figure 17:
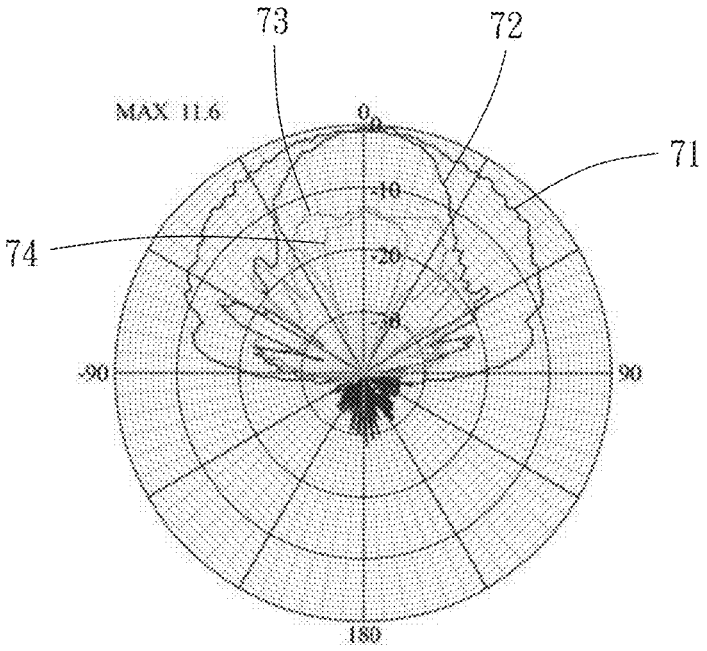
FIG. 17 is a data diagram obtained when the feed horn according to the third preferred embodiment of the present invention is used alone.
Figure 18:
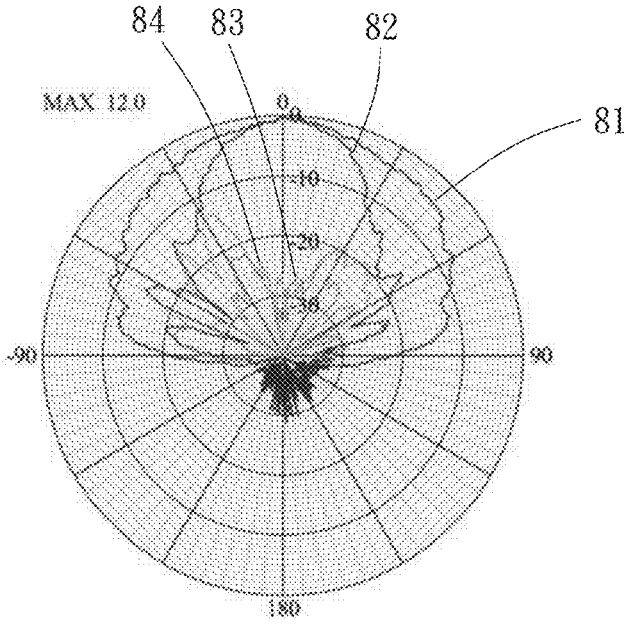
FIG. 18 is a data diagram obtained when the feed horn and the radome according to the third preferred embodiment of the present invention are used together.

FIG. 17 shows the intensity of electric wave obtained when the feed horn 61 sends out electric waves of 12.45 GHz by testing at the middle wave guiding space 112*a*. FIG. 18 shows the intensity of electric wave obtained when the feed horn 61 is covered by the radome 62 and sends out electric waves of 12.45 GHz by testing at the middle wave guiding space 112*a*. In FIGS. 17-18, curves 71, 81 represent the wave forms of H-cut co-polarization waves; curves 72, 82 represent the wave forms of E-cut co-polarization waves; curves 73, 83 represent the wave forms of H-cut cross polarization waves; curves 74, 84 represent the wave forms of E-cut cross polarization waves.

It can be observed at 0 degree on the coordinates in FIG. 17 that the difference between the intensity of the co-polarization wave and the cross polarization wave is about 14 dB when the feed horn 61 is not covered by the radome 62, and the directivity obtained in the same situation is 11.6 dB. It can be observed at 0 degree on the coordinates in FIG. 18 that the difference between the intensity of the co-polarization wave and the cross polarization wave is about 27 dB when the feed horn 61 is covered by the radome 62, and the directivity obtained in the same situation is 12.0 dB. In other words, the radome 62 increases the isolation of the co-polarization wave and the cross polarization wave by about 13 dB and the directivity by 0.4 dB.

Figure 19:
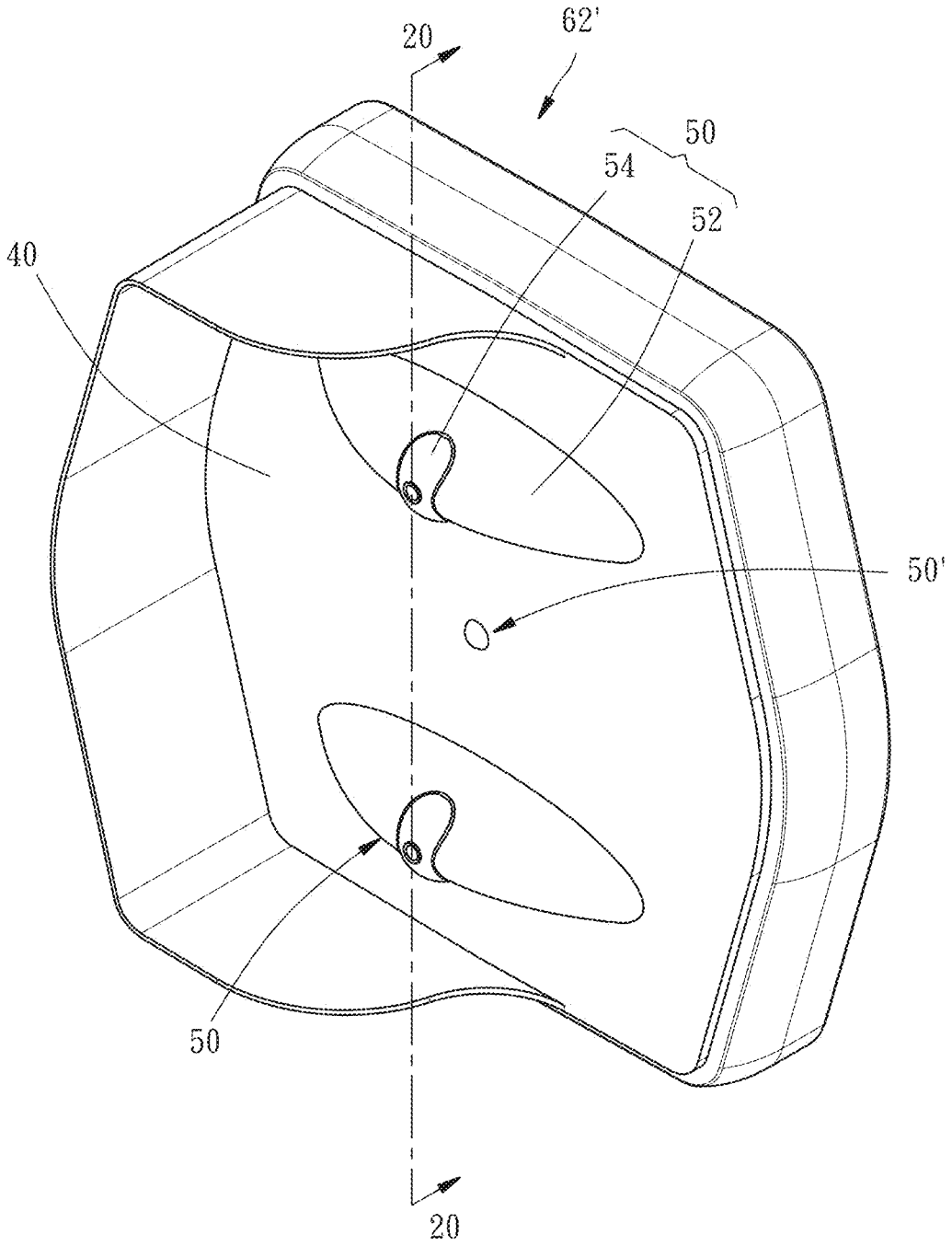
FIG. 19 is a perspective view of a radome for a feed horn according to a fourth preferred embodiment of the present invention.
Figure 20:
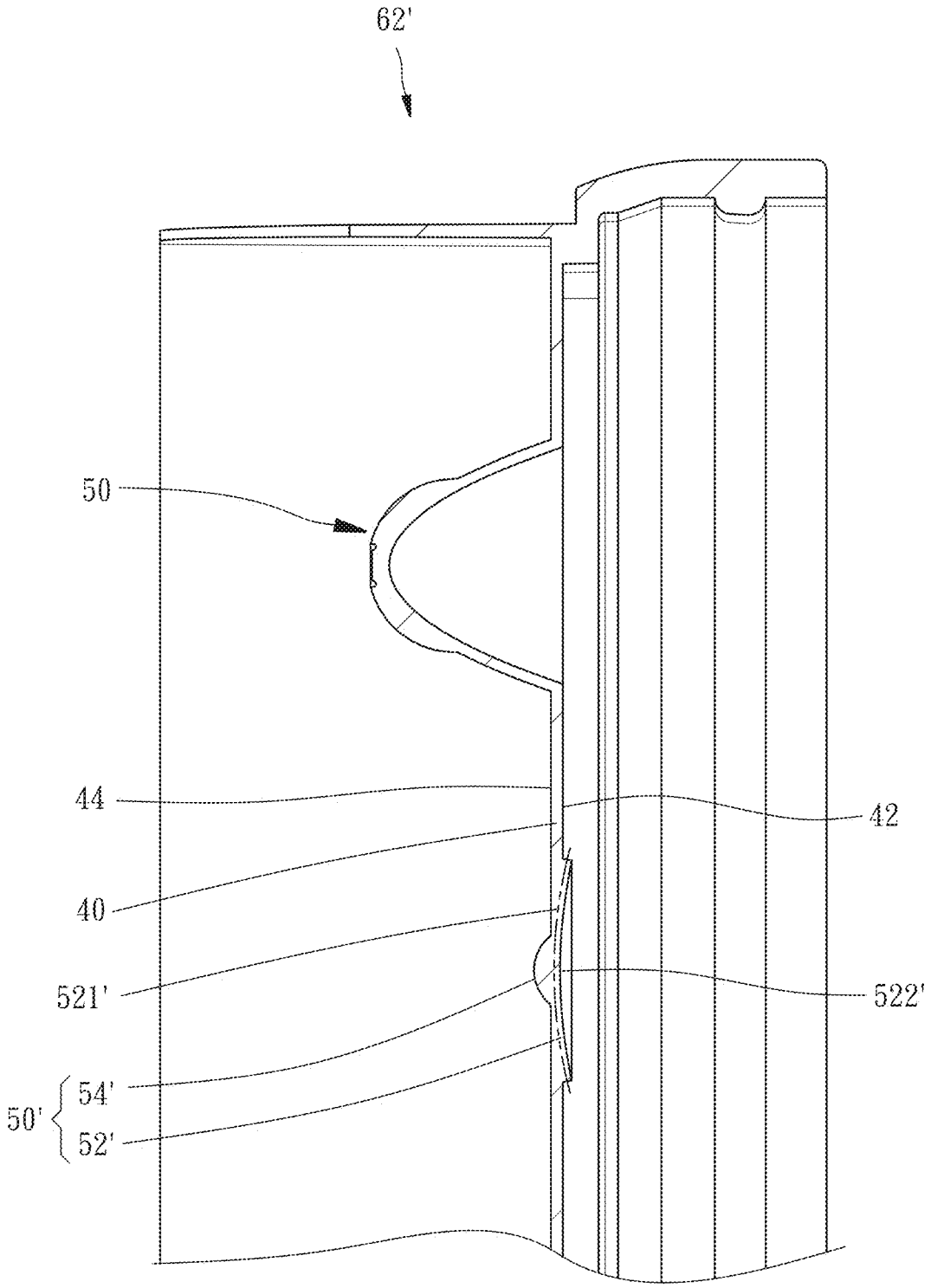
FIG. 20 is a sectional view taking along the line 20-20 in FIG. 19.

In the present invention, the elliptic protruding portion of the radome for the feed horn is positioned according to the wavefronts of the electric waves received by the wave guiding unit corresponding to the elliptic protruding portion. Therefore, the convex and concave surfaces of the elliptic protruding portion are unlimited to be curved outward and inward from the front and back surfaces of the cover respectively. For example, a radome 62' according to a fourth preferred embodiment of the present invention and shown in FIGS. 19-20 has two protrusions 50 as illustrated before, and a protrusion 50' located between the protrusions 50 and going to be more close to the feed horn than the protrusions 50. The elliptic protruding portion 52' of the protrusion 50' is overlapped with the cover 40 so that the convex surface 521' of the elliptic protruding portion 52' is concealed in the cover 40. Besides, the elliptic protruding portion 52' is partially protruded from the back surface 42 of the cover 40 so that the concave surface 522' of the elliptic protruding portion 52' is not curved inward from the back surface 42. This kind of protrusion 50' can also improve the isolation and the directivity of the electric waves received by the feed horn.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A radome for covering a feed horn and being passed through by a co-polarization wave and a cross polarization wave substantially perpendicular to the co-polarization wave, the radome comprising:

a cover provided with a back surface and a front surface; and at least a protrusion having an elliptic protruding portion shaped as a part of a hollow ellipsoid and having a convex surface and a concave surface opposite to the convex surface;

wherein the radome is defined with a plurality of first cross-sections parallel to a first axis and a second axis substantially perpendicular to the first axis, and a plurality of second cross-sections parallel to the first axis and a third axis substantially perpendicular to the first axis and the second axis; curves of the convex surface and the concave surface in the first cross-sections are different from curves of the convex surface and the concave surface in the second cross-sections; the convex surface and the concave surface are substantially perpendicular to an advancing direction of the co-polarization wave and unperpendicular to an advancing direction of the cross polarization wave.

2. The radome as claimed in claim 1, wherein the convex surface is curved outward from the front surface of the cover; the concave surface is curved inward from the back surface of the cover.

3. The radome as claimed in claim 1, wherein each of the curves of the convex surface and the concave surface of the elliptic protruding portion of the protrusion in each of the first cross-sections is a circular arc with a consistent radius of curvature; each of the curves of the convex surface and the concave surface in each of the second cross-sections has a center, two ends and an inconsistent radius of curvature increasing from the center to the ends.

4. The radome as claimed in claim 1, wherein the protrusion further has a spherical protruding portion protruded from the convex surface of the elliptic protruding portion and shaped as a part of a spheroid.

5. The radome as claimed in claim 1, wherein the elliptic protruding portion has an outer contour which is elongated and therefore defined with a long axis connecting two most distant points of the outer contour and parallel to the second axis.

6. The radome as claimed in claim 5, comprising a plurality of said protrusions aligned substantially along the third axis;

the long axes of the outer contours of the elliptic protruding portions of the protrusions are substantially parallel to each other.

7. An assembly comprising a feed horn and the radome of claim 1 covering the feed horn, wherein the feed horn comprising at least a wave guiding unit having a pipe, a wave guiding space in the pipe, and an opening located at an end of the pipe, and defined with a central axis substantially passing through the opening perpendicularly; the concave surface of the elliptic protruding portion of the protrusion of the radome faces the wave guiding space of the feed horn.

8. The assembly as claimed in claim 7, wherein each of the curves of the convex surface and the concave surface of the elliptic protruding portion of the protrusion in each of the first cross-sections is a circular arc with a consistent radius of curvature; each of the curves of the convex surface and the concave surface in each of the second cross-sections has a center, two ends and an inconsistent radius of curvature increasing from the center to the ends.

9. The assembly as claimed in claim 7, wherein the protrusion of the radome further has a spherical protruding portion protruded from the convex surface of the elliptic protruding portion and shaped as a part of a spheroid.

10. The assembly as claimed in claim 7, wherein the elliptic protruding portion of the radome has an outer contour which is elongated and therefore defined with a long axis connecting two most distant points of the outer contour and parallel to the second axis.

11. The assembly as claimed in claim 10, wherein the opening of the feed horn is elongated and therefore defined with a long axis connecting two most distant points of the opening; the long axis of the opening is parallel to the long axis of the outer contour of the elliptic protruding portion of the radome.

12. The assembly as claimed in claim 10, wherein the feed horn comprises a plurality of said wave guiding units; the radome comprises a plurality of said protrusions aligned substantially along the third axis; the concave surfaces of the elliptic protruding portions of the protrusions face the wave guiding spaces of the wave guiding units respectively; the long axes of the outer contours of the elliptic protruding portions are substantially parallel to each other.

13. The assembly as claimed in claim 7, wherein the wave guiding unit of the feed horn further has at least a tilted side-lobe-reducing corrugation located at an outside of the pipe and having an inner surface facing the pipe; the inner surface has a first end and a second end and is tilted relative to the central axis from the first end to the second end; the first end is farther from the opening of the pipe and more close to the central axis than the second end.

14. The assembly as claimed in claim 13, wherein the opening of the feed horn is elongated and therefore defined with a long axis connecting two most distant points of the opening; the wave guiding unit has two said tilted side-lobe-reducing corrugations located at two ends of the long axis of the feed horn.

15. The assembly as claimed in claim 14, wherein the opening of the feed horn is defined with a short axis intersecting the long axis of the feed horn; the wave guiding unit further has two parallel side-lobe-reducing corrugations located at the outside of the pipe and two ends of the short axis; each of the parallel side-lobe-reducing corrugations has an inner surface facing the pipe and substantially parallel to the central axis.

16. The assembly as claimed in claim 14, wherein the opening of the pipe has two long sides and two short sides; said two tilted side-lobe-reducing corrugations are located by said two short sides, respectively.

17. The assembly as claimed in claim 16, wherein the wave guiding unit further has two parallel side-lobe-reducing corrugations located by said two long sides respectively; each of the parallel side-lobe-reducing corrugations has an inner surface facing the pipe and substantially parallel to the central axis.

18. The assembly as claimed in claim 14, wherein the feed horn comprises a plurality of said wave guiding units; the long axes of the openings of the wave guiding units are substantially parallel to each other; the wave guiding units are aligned along a direction substantially perpendicular to the long axes of the wave guiding units.

19. The assembly as claimed in claim 13, wherein the pipe is surrounded by the tilted side-lobe-reducing corrugation.

20. The assembly as claimed in claim 13, wherein an extension plane of the inner surface of the tilted side-lobe-reducing corrugation intersects the central axis of the pipe; an included angle between the extension plane and the central axis is more than or equal to 30 degrees and less than or equal to 60 degrees.

* * * * *